United States Patent [19]

Koepke et al.

[11] 3,983,614

[45] Oct. 5, 1976

[54] METHOD FOR PRODUCING A CHAIR

[75] Inventors: Earl H. Koepke; Alan R. Reichard, both of Sturgis, Mich.

[73] Assignee: Harter Corporation, Sturgis, Mich.

[22] Filed: Apr. 4, 1975

[21] Appl. No.: 565,244

Related U.S. Application Data

[62] Division of Ser. No. 429,051, Dec. 28, 1973, Pat. No. 3,904,242.

[52] U.S. Cl. ..... 29/91.1; 29/91.5

[51] Int. Cl.[2] ..... B68G 7/00

[58] Field of Search ..... 29/91.1, 91, 91.5; 297/DIG. 1

[56] References Cited

UNITED STATES PATENTS 3,647,260 3/1972 Carrington ..... 297/DIG. 1

*Primary Examiner*—Gil Weidenfeld

*Attorney, Agent, or Firm*—Hamilton, Renner & Kenner

[57] ABSTRACT

The present invention is directed to a chair construction and a method for fabricating such a chair. At least a portion of the chair frame is adapted to be upholstered with a removable decorative cover, and that portion — or a component thereof may, comprise a shell having a mounting flange and a groove extending around the perimeter of the shell in substantially parallel relation with respect to the mounting flange. A bumper embraces the mounting flange and presents an anchor rib that is received within the groove. The configuration of the exterior of the bumper as well as the anchor rib cooperates with the shell to prevent inadvertent removal. A cover overlies the shell and is secured to the bumper by hidden stitching. The cover may be infolded within the resilient cushion material interposed between the cover and the shell to present one or more decorative grooves and to preclude stressing the stitching by which the cover is secured to the bumper.

8 Claims, 13 Drawing Figures

15
25
41b
39
43
65
49
40
48
41a
36
23a
32
30
35
20
33
31
22
34
42
70
19
18
21
45
46
16
44a
10
11
12
13
14a
14b
40a
40b
2
4
24

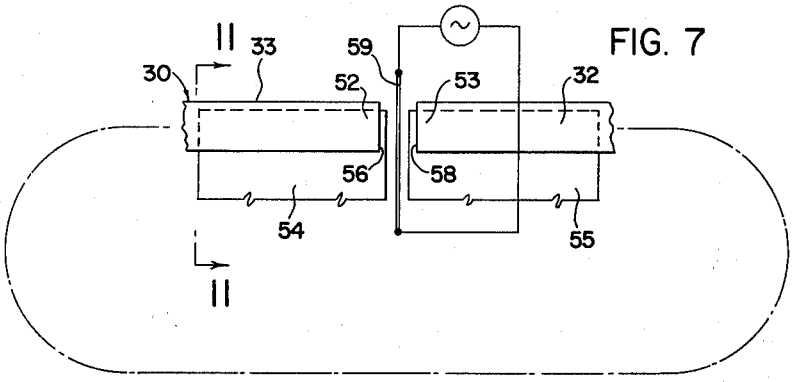
FIG. 7
FIG. 8
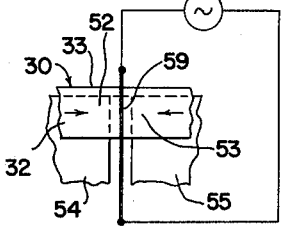
FIG. 9
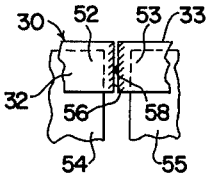
FIG. 10
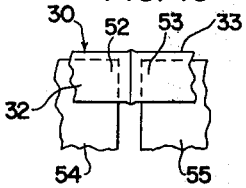
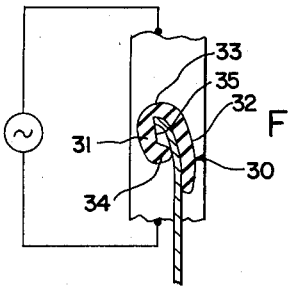
FIG. 11

METHOD FOR PRODUCING A CHAIR

This is a division of Application Ser. No. 429,051, filed Dec. 28, 1973, now U.S. Pat. No. 3,904,242.

BACKGROUND OF THE INVENTION

The present invention relates to a chair construction and particularly to an arrangement whereby a decorative cushion cover may be removably secured to at least a portion of the frame itself.

The prior art discloses a plurality of means by which a cover may be secured to the frame of a chair, but each prior known arrangement has serious drawbacks. For example, one of the most common ways in which a cover is fastened to the frame of a chair is by gluing or stitching the two components together. Gluing and stitching do not foreclose removal of the cover, but they considerably complicate the removal and replacement. If the cover is stitched, the stitching must first be cut away to remove the cover, and if the same cover were to be retained this would require one to proceed most carefully in order not to damage the cover material, and even after the most painstaking care some material would be sufficiently damaged by having been originally stitched to preclude further use thereof. Moreover, even if the cover were wholly replaced, the holes made through the chair frame to accommodate the original stitching might or might not be acceptable for restitching.

On the other hand, if glue had been used the cover material would probably be too badly damaged during its removal for one to consider reusing it. Then too, the dried, residual glue would have to be scraped off of the chair and if the replacement cover were also to be glued, sufficient time would be required after the replacement cover had been installed for the glue to harden.

To obviate the difficulties attendant upon such semi-permanent means of securing the cover as stitching and gluing, the prior art has also proposed compressively inserting conjoined cushions and covers into appropriate lateral retaining slots in the frame of the chair, but such arrangements tend to become too loose during use.

As a compromise between these two extremes the prior art has proposed the use of a variety of special fasteners by which the cover is retained to the frame of the chair, but these have heretofore been too readily removable by inadvertent manipulation, have required at least semi-skilled personnel to effect removal and/or reinstallation or have been too expensive to manufacture and maintain. Moreover, to allow facile replacement of the cover, the aesthetic appearance of the chair has often suffered unduly.

SUMMARY OF THE INVENTION

It is, therefore, a primary object of the present invention to provide a unique configuration for removably attaching a cover to the frame of a chair.

It is another object of the present invention to provide a unique configuration for removably attaching a cover to the frame of a chair, as above, which employs an aesthetically pleasing bumper.

It is another object of the present invention to provide a unique construction for removably attaching a cover to the frame of a chair, as above, in which the seam by which the cover is secured to the bumper can be hidden from view.

It is still another object of the present invention to provide a unique configuration for removably attaching a cover to the frame of a chair, as above, which is readily adapted to use with cover materials through a relatively wide range of thickness.

It is a further object of the present invention to provide a unique configuration for removably attaching a cover to the frame of a chair, as above, which, though removable with facility by one familiar with its construction, is not readily removable through inadvertence or by one unfamiliar with the arrangement.

It is a still further object of the present invention to provide a unique configuration for removably attaching a cover to the frame of a chair, as above, which obviates tension on the seam between the cover material and the bumper.

It is an even further object of the present invention to provide a unique configuration for removably attaching a cover to the frame of a chair, as above, in which the tension free condition between the cover material and the bumper is effected by a novel means for providing and maintaining a decorative channel in the cushion material interposed between the cover and the frame of the chair.

It is also an object of the present invention to provide a method for fabricating the unique configuration for removably attaching a cover to the frame of a chair, as above.

These and other objects, together with the advantages thereof over existing and prior art forms which will become apparent from the following specification, are accomplished by means hereinafter described and claimed.

In general, a chair embodying the concept of the present invention has a frame at least one portion of which may comprise a structural shell having oppositely and outwardly directed first and second face walls. A mounting flange and a recessed groove extend around and define the perimeter of the shell.

A flexible bumper has two generally parallel jaws that are conjoined along one edge, and an anchor rib that extends from the distal edge of the first jaw generally toward the second jaw. The jaws of the bumper are adapted grippingly to embrace the mounting flange with the anchor rib received within the groove. The exposed surface of the first jaw terminates in juxtaposition to the first face wall of the shell, thereby precluding inadvertent removal of the bumper.

A cover overlies the shell and is attached to the bumper, preferably by hidden stitching. This is accomplished by having the cover overlie one of the jaws on the bumper — preferably the second jaw — with an inseam flap underlying the cover, the inseam flap being stitched to the second jaw of the bumper.

Stress on the stitching that joins the inseam flap to the bumper may be eliminated by infolding the cover material into the resilient cushion material interposed between the cover and the shell so that when normal loading is applied to the chair, any resulting stress will be accommodated by the infolded grooves rather than be applied against the stitching.

In order to fabricate a chair according to the method of the subject invention, one may extrude a continuous ribbon of resilient material having the cross section desired for the bumper. A strip of predetermined length is severed from the ribbon, the strip is hooped to bring the opposite ends into opposed, abutting relation and the abutting ends are joined together to form a continuous bumper. In order to enhance the gripping engagement between the bumper and the portion of the chair frame it is intended to interengage, the unstressed, normal circumference of the hooped bumper is preferably less than the circumference of that portion of the frame on which the bumper is to be mounted.

After being hooped the bumper is introverted, stretched to its mounted circumference and positioned according to a predetermined pattern on the finished surface of a piece of material from which the cover is to be formed. The bumper and cover are then secured together, as by stitching, and the bumper is retrorotated to hide the seam. The bumper is then mounted on the frame, or at least a portion thereof.

In the event a cushion is to be employed, resilient cushion material may be interposed between the frame and the cover, and an anchor tab secured to the cover may be buttonholed behind a portion of the resilient cushion material. By selectively locating the tab, the cover material may be infolded with respect to the resilient cushion material in order to provide a decorative appearance and at the same time relieve stress on the stitching.

One preferred form of a chair embodying the concept of the present invention, together with a disclosure of a preferred method by which such a chair may be fabricated, are shown by way of example in the accompanying drawings without attempting to show all of the various forms and modifications in which the invention might be embodied; the invention being measured by the appended claims and not by the details of the specification.

DESCRIPTION OF THE DRAWINGS

FIG. 7 is a schematic representation of one way in which to hoop a strip cut from the ribbon depicted in FIG. 6;

FIG. 8 depicts a portion of FIG. 7 in which the opposed and registered ends of the hooped strip are brought into abutting contact with the opposed faces of a heating element;

FIG. 9 is a view similar to FIG. 8 with the opposed and registered ends of the strip having been heated but with the heating element removed;

FIG. 10 is a view similar to FIGS. 8 and 9 depicting the opposed and heated ends of the strip brought into contact, whereby to effect a butt weld;

FIG. 11 is a section taken substantially along line 11—11 of FIG. 7;

DESCRIPTION OF THE PREFERRED EMBODIMENT

Figures 1, 2, 3:
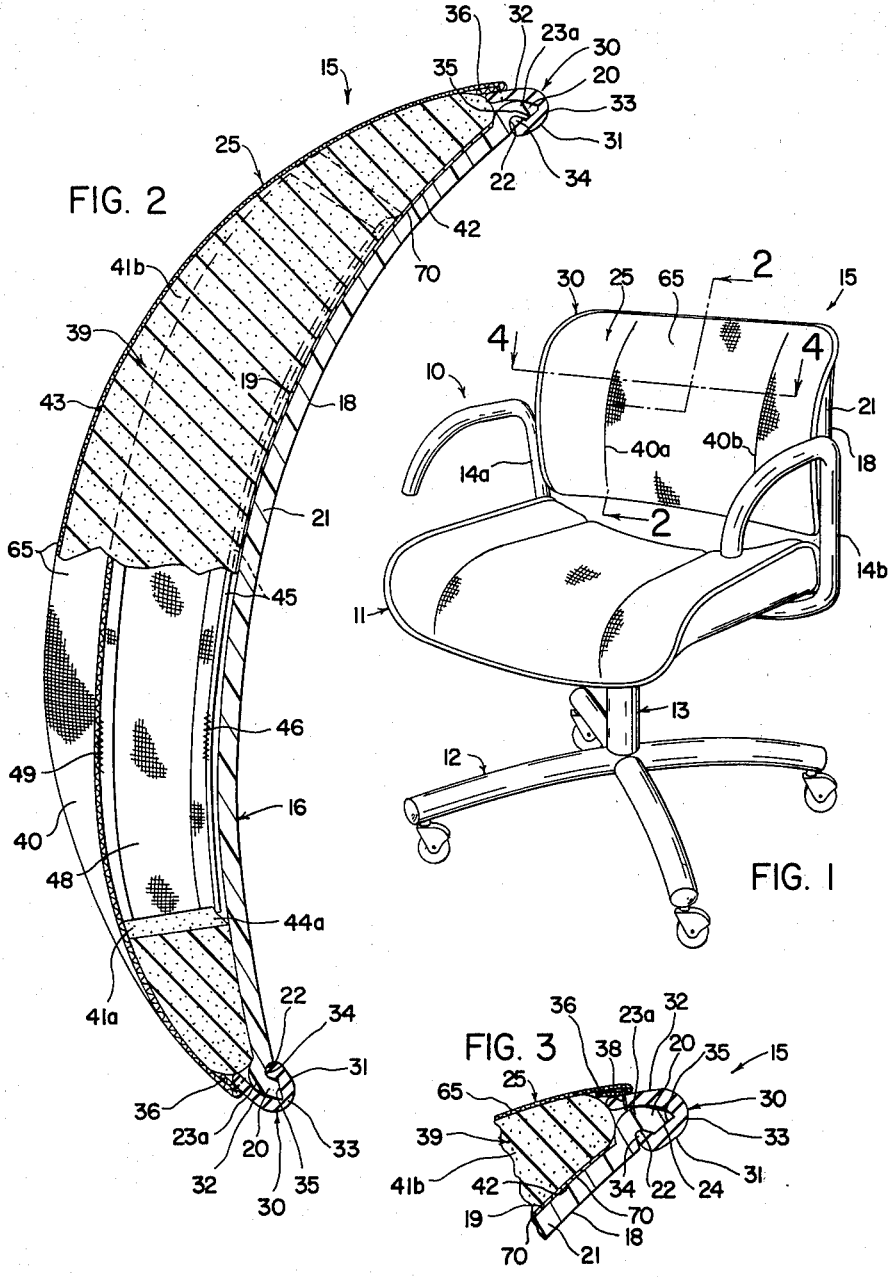
FIG. 1 is a frontal-side perspective of a chair embodying the concept of the present invention.
FIG. 2 is an enlarged vertical section taken substantially along line 2—2 of FIG. 1.
FIG. 3 is a further enlarged area of FIG. 2 depicting the interengagement of the bumper with a portion of the chair frame in the form of a shell and further depicting the connection of the cover to the bumper and the resilient cushion material interposed between the cover and the shell.

A chair embodying the concept of the present invention is designated generally by the numeral 10 on the attached drawings. Although the present invention is disclosed in conjunction with a pedestal type chair, it will become apparent that the present invention would be eminently suitable for a wide variety of upholstered furniture.

The representative chair 10 has a seat section 11 that is supported upwardly of a base portion 12 by a column, or pedestal, 13. A pair of arms 14*a* and 14*b* are attached to the seat section 11 and carry a back section 15.

Although the seat section 11 and back section 15 may constitute individual components, as shown, it must be appreciated that they could as well be combined into a single, contoured structure and still fall within the concept of the present invention. It should also be appreciated that whereas only the configuration of the back section 15 will be described in detail, that description is equally applicable to the seat section 11, the structural details of which may also embody the concept of the present invention.

The portion of the chair frame imparting structural integrity to the back section 15 is represented as being a shell 16 that has oppositely and outwardly directed faces 18 and 19. The shell 16 may be made of virtually any solid material such as wood, metal or plastic. However, the latter construction is becoming extremely popular, especially a rigid material known as fiber reinforced polyester resin that comprises glass or other type fiber embedded in a cured polyester resin thermosetting plastic. This construction is not only inexpensive, but fiber reinforced polyester resin materials are: chemically inert, resistant to corrosion and hydrolytic degradation, relatively insensitive to thermal changes and have numerous other features which make them desirable for use as the supporting, or frame, component of a chair.

A mounting flange 20 is provided along, and thereby defines, the perimeter of the shell 16. The mounting flange 20 is angularly disposed with respect to the body portion 21 of the shell in order to delineate a groove 22 in conjunction with the first face 18 of the shell. As shown in FIGS. 2 and 3, an offset wall 23*a* extends between the mounting flange 20 and body portion 21 of the shell 16 to provide the requisite groove 22.

Still referring to FIGS. 2 and 3, the mounting flange 20 is inclined such that the foot, or terminal face, 24 thereof may lie in a plane that constitutes an extension to the plane tangential to the first face 18 immediately across the span of the groove 22.

Figure 4:
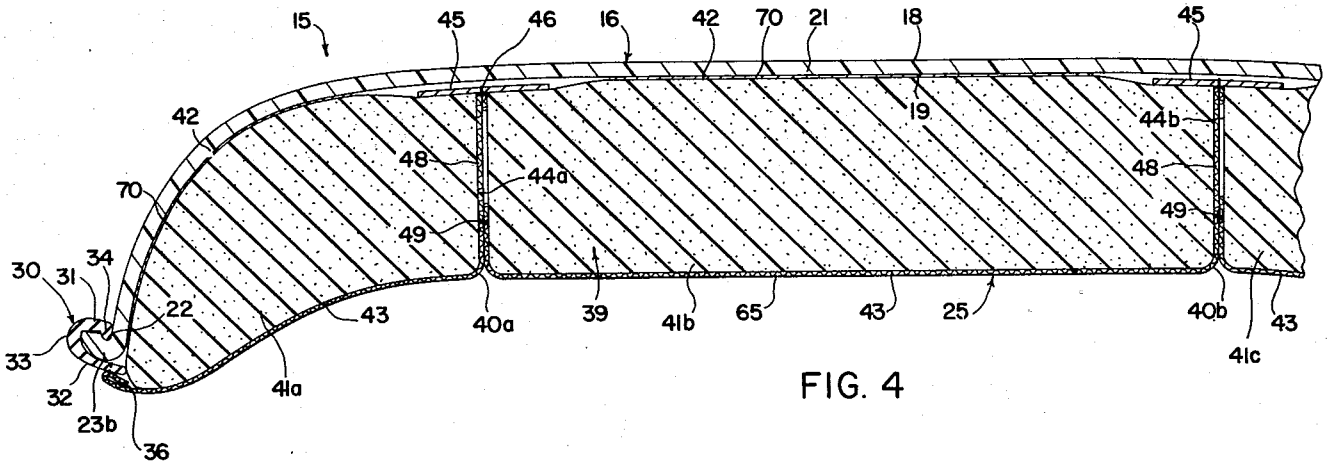
FIG. 4 is an enlarged horizontal section taken substantially on line 4—4 of FIG. 1.
Figure 5:
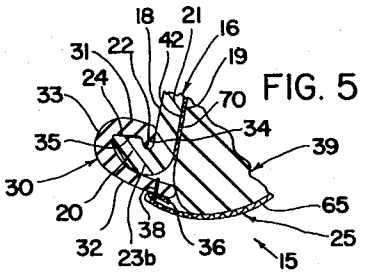
FIG. 5 is a further enlarged area of FIG. 4 depicting a slightly modified interrelationship of the elements shown in FIG. 3.

On the other hand, it can be seen from FIGS. 4 and 5 that whereas an offset wall 23*b* also connects the mounting flange 20 to the body portion 21 of the shell 16 in order to present the requisite groove 22, the mounting flange 20 in FIGS. 4 and 5 is angularly disposed with respect to the body portion such that the foot, or terminal face, 24 of the flange 20 may lie in a plane that is oriented perpendicularly to the face 18 across the span of groove 22. The particular angular disposition of mounting flange is selected such that the cover 25 (which is removably positioned over the second face 19 of the shell 16 by virtue of a bumper 30 which cooperatively interengages the mounting flange 20 and groove 22) will extend smoothly outwardly from the bumper 30.

Figure 6:
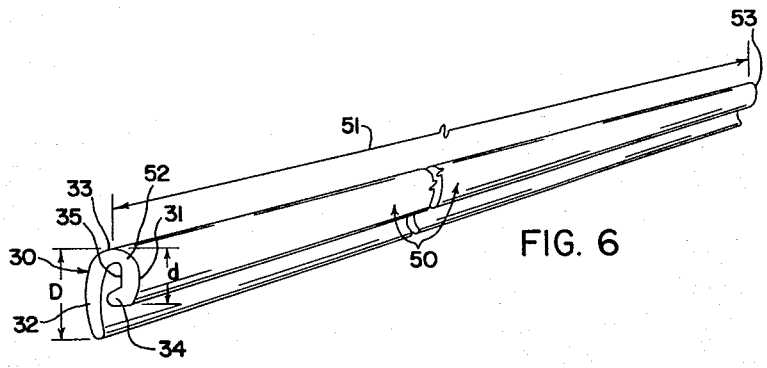
FIG. 6 is a frontal-side perspective of a ribbon from which a strip may be severed for forming the bumper by which a cover is demountably secured to a chair.

As best seen in FIG. 6, the bumper 30 is comprised of opposed jaws 31 and 32 that are integrally joined along one edge to present a smoothly rounded surface at the juncture 33. An anchor rib 34 is presented from the edge of the first jaw 31 distal with respect to juncture 33 and is oriented to extend toward the second jaw 32. Anchor rib 34, which terminates in immediate proximity to the second jaw 32, is adapted to be received within the groove 22. Medially of the rib 34 and the juncture 33, the first jaw 31 presents a generally planar surface 35 adapted to engage the terminal face 24 of the mounting flange 20.

The second jaw 32 curves gently outwardly from the juncture 33 and terminates in spaced relation outwardly of the first jaw 31. In fact, in the preferred form the width dimension "D" of the second jaw 32 is approximately 50 percent greater than the width dimension "*d*" of the first jaw 31.

The edge portion of the cover 25 is underlapped to present an inseam flap 36 which overlies a portion of the second jaw 32 and is secured thereto, as by stitching 38 which is hidden from view by the cover 25 itself.

A resilient material 39 may be interposed between the cover 25 and the second face 19 of the shell 16 to provide a cushioned construction. The preferred material for the cushion layer is flexible polyurethane foam because of its good aging properties, its resistance to mildew and the like; however, other materials such as polyethylene or polypropylene foam, polyvinyl chloride foam and other similar materials may be used.

In order to preclude stress on the stitching 38 when resilient cushion material is employed, one or more channels 40 may be provided. Each channel 40 comprises an infolding of the material forming the cover 25. In the embodiment depicted in the drawings, the back section 15 employs two laterally spaced channels **40*a* and 40*b*, and it is quite convenient to effect such an arrangement by using three pieces 41*a*, 41*b* and 41*c* of the resilient material 39. Each piece 41*a*, 41*b* and 41*c* has an inner surface 42 that is directed toward the second face 19 of the shell 16 and an outer surface 43 directed toward the cover 25. The adjacent pieces 41*a* and 41*b* present a first interface 44*a* that extend between the shell 16 and the cover 25, and the adjacent pieces 41*b* and 41*c* present a second, similarly oriented interface 44*b*. The cover 25 is infolded at least partially within the two interfaces 44*a* and 44*b* to produce the channels 40*a* and 40*b***, respectively.

The infolded disposition of the cover 25 which produces each channel **40*a* and 40*b* is maintained by a tab 45 secured to the cover and buttonholed behind at least a portion of the resilient cushion material 39. As best shown in FIGS. 2 and 4, the tab 45 is fastened, as by stitching 46, to a pendant 48 that is, in turn, fastened to the cover 25, as by stitching 49. The length of the pendant 48 is selected to permit the tab 45 to be received between the resilient cushion material 39 and the shell 16 and at the same time provide sufficient depth to the channel 40 so that the load applied against the cushion cover will not attempt to stretch the cover away from the stitching 38 but will provide any excess material from the infolded channels 40** as may be required to accommodate the load.

In order to fabricate a chair embodying the concept of the present invention one produces a chair frame of the desired configuration — e.g., shell 16. One must also produce a suitable bumper 30. The bumper 30 should preferably possess only moderate flexibility at room temperature in order to minimize removal by other than those completely familiar with the present concept. Yet, the bumpers 30 should be capable of being made temporarily more resilient in order to facilitate installation. Polyvinyl chloride can be formulated to provide the desired moderate flexibility at room temperature and can be made temporarily more resilient by modest heating. As such, it is a highly desirable material for the present purpose. However, other elastomeric polymers may be substituted for polyvinyl chloride. For example, one may use butadiene rubber, isoprene rubber, chloroprene rubber, acrylate-butadiene rubber, isobutylene-isoprene rubber, nitrile-butadiene rubber, nitrile-chloroprene rubber, pyridine-butadiene rubber, styrene-butadiene rubber, styrene-chloroprene rubber, styrene-isoprene rubber and elastomer-plastic blends — for example, nitrile rubber-polyvinyl chloride blends, urethane rubber-nylon blends, butadiene rubber-polypropylene blends, etc.

Assuming that one elects to use a polyvinyl chloride, a continuous ribbon 50 (FIG. 6) of vinyl can be extruded in conformity with the cross section desired for the bumper 30, and a strip 51 of predetermined length can be cut from the ribbon. The length of the cut strip is predetermined by the lineal dimension required for a bumper 30 to extend around the perimeter of the particular shell configuration on which it is to be received. It is preferred that the predetermined length of the strip 51 be slightly less than the lineal dimension required for a bumper to extend around the shell in order that the bumper formed from the strip 51 will be at least slightly stretch-stressed when positioned on the shell, thereby enhancing the interengagement between the bumper and the shell on which it is received.

The strip 51 is hooped as depicted in FIG. 7, and the opposite ends 52 and 53 are secured together. If polyvinyl chloride is used for the bumper the abutting ends may be heat sealed together. As shown in FIG. 8 the jaws 31 and 32 on each end 52 and 53 may be fitted over opposed, aligned blades 54 and 55 and the ends brought into abuttment with the opposite faces 56 and 58 of a relatively thin heating element 59 that can be removed (FIG. 9) when the ends 52 and 53 are sufficiently heated to effect a butt weld as they make contact (FIG. 10). Any flash resulting from this weld may be removed before continuing the process.

Continuing with the example of a polyvinyl chloride bumper, the hooped bumper 30 is preferably heated to afford pliability, introverted, stretched to a circumference equal to the lineal dimension it will assume when mounted on the shell and releasably secured to a template 60. In its normal configuration the bumper 30 is oriented with the juncture 33 facing radially outwardly and the jaws 31 and 32 extending radially inwardly, but when introverted the juncture 33 faces radially inwardly and the jaws 31 and 32 extend radially outwardly. The bumper 30 is secured to the template in the introverted position (FIG. 13).

Figure 12:
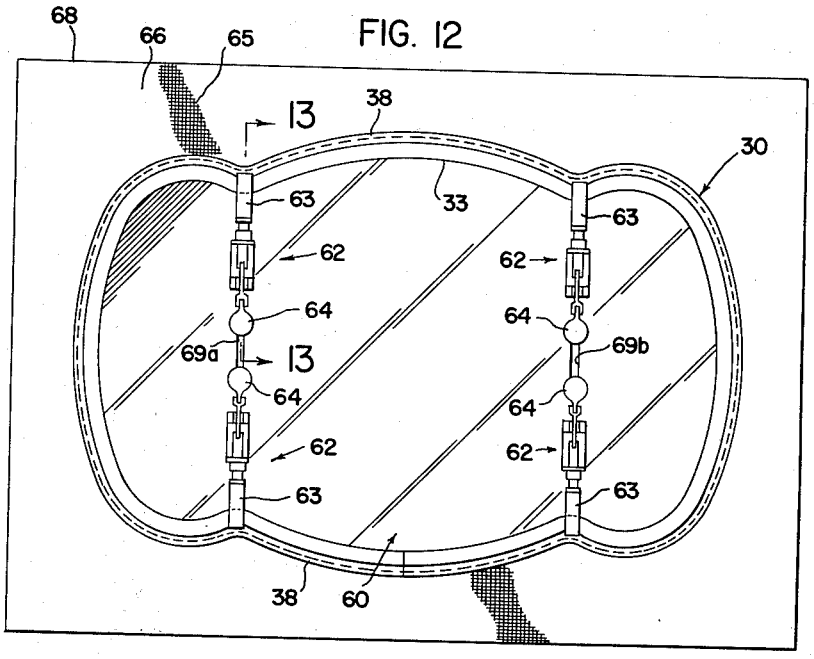
FIG. 12 is a top plan of a template used to position the hooped bumper with respect to the cover material so that it might be secured thereto; and, FIG. 13 is an enlarged cross section taken substantially along line 13—13 of FIG. 12.
Figure 13:
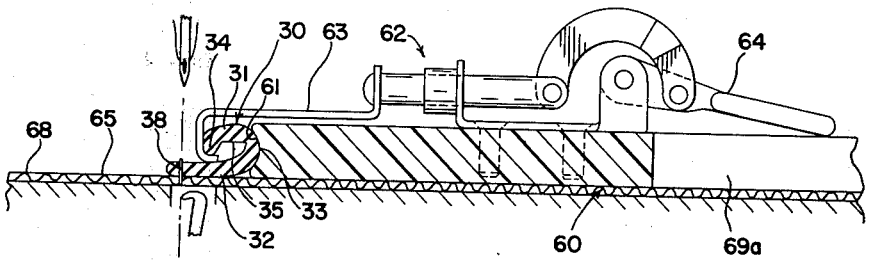

As best seen in FIGS. 12 and 13 the template 60 comprises a rigid, preferably transparent material such as lucite, the peripheral edge 61 of which is coved to receive the rounded juncture 33. With the juncture 33 thus nested within the coved edge 61 a plurality of securing members 62 engage the bumper 30 and lock it to the template 60. Each securing member 62 may well comprise a hook portion 63 that is receivable between the jaws 31 and 32 and attached to an overcenter, throw lock 64.

The template 60 with the introverted bumper 30 secured thereto is positioned on the finished surface 65 — i.e., the surface that is to be exposed — of the material from which the cover 25 is to be formed. So positioned, the longer, second jaw 32 contacts the finished surface 65 of the material 66, and the stitching 38 is applied to secure the second jaw 32 to the cover 25. Because the bumper is stretched to its mounted dimension when positioned on the template, the dimensional relationship required between the cover material and the bumper when installed on the chair will be assured at the time the bumper is secured to the cover material.

The excess border 68 of the material 66 may then be trimmed in proximity to the bumper 30 but sufficiently spaced from the stitching 38 to leave an inseam flap 36.

Before the conjoined cover 25 and bumper 30 are removed from the template 60 it is desirable to mark the location, or locations, on the cover 25 at which the tabs 45 and/or pendants 48 will be secured. This may well be accomplished by marking the cover 25 with a removable substance along the slots 69*a* and 69*b*.

Thereafter, the securing members 62 are released and the conjoined cover 25 and bumper 30 are removed from the template. The bumper is retrorotated so that the juncture 33 faces radially outwardly and the jaws 31 and 32 extend radially inwardly. This retrorotation of the bumper causes the inseam flap 36 to underlie the cover 25 and thereby hide the stitching 38 when the cover 25 and bumper 30 are viewed from the finished surface 65 side of the cover.

The pieces 41 and resilient cushion material 39 are preferably secured to the second face 19 of shell 16 by a suitable adhesive 70. The resilient cushion material 39 may be bonded to the shell 16 by a wide range of adhesives as long as they are compatible with the particular materials used in those elements. Examples of adhesives usable herein include acrylic and methacrylic adhesives, bitumen adhesives, casin, cellulose acetate and cellulose caprate adhesives, cellulose nitrate and cyano acrylate adhesives, epoxy polyamide adhesives, phenolic-polyamide, phenolic-vinyl adhesives, polyamides, polyisobutylenes, polystyrene, polyvinyl acetyl, polyvinyl acetate, rosin adhesives, epoxies, furanes, melamine-formaldehyde adhesives, oleo resins, pehnol-formaldehyde adhesives, phenolic-epoxy, phenolic-neoprene adhesives, phenolic-nitriles, polyester adhesives and polyurethane adhesives, resorcinol-formaldehyde and ureaformaldehyde adhesives, polychloroprene adhesives and acrylonitrile-butadiene adhesives. Specifically preferred in this respect are adhesives known as the "contact" adhesives.

When a plurality of pieces 41 are employed one should be careful to apply the adhesive such that it does not rigidly secure the resilient cushion material 39 to the shell 16 at any location along the interfaces 44 where the tabs 45 are to be buttonholed between the cushion material 39 and the shell 16.

In order to facilitate final assembly when employing a vinyl bumper 30 it may be desirable, or perhaps even necessary, to warm the bumper such that it possesses a sufficient degree of flexibility that the jaws 31 and 32 may be positioned to embrace the mounting flange 20. As the bumper 20 is positioned on the shell 16, the tabs 45 are buttonholed through the appropriate interface 44 until, in the example depicted, the entire back section 15 is assembled.

It should now be apparent that the chair embodying the concept of the present invention can be fabricated according to the method thereof to provide a uniquely mountable and demountable cover and otherwise accomplish the objects of the invention.

We claim:

1. A method for fabricating a chair comprising the steps of; providing a chair having a frame which presents a mounting flange around the periphery thereof, forming a continuous bumper the cross section of which is adapted to embrace the peripheral flange of the chair frame, disposing said bumper in introverted position on the finished surface of the material from which a cover is to be formed, securing said bumper to the cover material, retrorotating the bumper with the cover material secured thereto, and mounting said bumper on said chair frame by positioning said bumper embracingly to engage the mounting flange along the periphery of the chair frame.

2. A method for fabricating a chair, as set forth in claim 1, comprising the additional steps of; providing a template, and releasably securing the continuous bumper to the template so that the bumper will be oriented according to a predetermined pattern before it is secured to the cover material.

3. A method for fabricating a chair, as set forth in claim 2, in which the bumper is secured to the cover material by stitching.

4. A method for fabricating a chair, as set forth in claim 3, in which the bumper is formed by the additional steps of; extruding a continuous ribbon, cutting a strip of predetermined length from said ribbon, hooping said strip to abut the opposed ends of the strip, and joining the abutting ends of said strip to form a bumper.

5. A method for fabricating a chair, as set forth in claim 4, comprising the additional steps of; selecting the predetermined length of the strip to be less than the lineal dimension required for a bumper to be mounted on the frame, and stretching the hooped bumper to its mounted dimension when releasably securing the bumper to the template.

6. A method for fabricating a chair, as set forth in claim 3, comprising the additional step of; interposing a resilient cushion material between the shell and the cover.

7. A method for fabricating a chair, as set forth in claim 6, comprising the additional steps of; providing an interface in the resilient cushion material, securing a pad to the cover, and buttonholing the tab through the interface to infold a portion of the cover.

8. A method for fabricating a chair, as set forth in claim 2, comprising the additional steps of; providing a slot in the template, placing a mark on the cover material along the slot in said template, securing a tab to the cover material along the mark, and buttonholing the tab through the interface to infold a portion of the cover.

* * * * *